US005533952A

United States Patent [19]

Schaber

[11] Patent Number: 5,533,952

[45] Date of Patent: Jul. 9, 1996

[54] HAND GRIP ASSEMBLY FOR CROSS-COUNTRY EXERCISER OR SIMILARLY-GRIPPED EXERCISE EQUIPMENT

[76] Inventor: Christopher R. Schaber, 15 Haywood Ct., Ft. Thomas, Ky. 41075

[21] Appl. No.: 551,042

[22] Filed: Oct. 31, 1995

[51] Int. Cl.[6] ..... A63B 22/00; A63B 5/20

[52] U.S. Cl. ..... 482/70; 482/82; 482/908

[58] Field of Search ..... 482/81, 82, 908, 482/126, 70, 148, 91, 121, 124

[56] References Cited

U.S. PATENT DOCUMENTS

| | | | |
|---|---|---|---|
| 134,527 | 1/1873 | Eastman | 482/126 |
| 4,685,670 | 8/1987 | Zinkin | 482/908 |
| 4,793,609 | 12/1988 | Coutts et al. | 482/126 |
| 4,955,601 | 9/1990 | Ueng | 482/82 |
| 5,052,681 | 10/1991 | Williams | 482/908 |
| 5,478,297 | 12/1995 | Dennis | 482/82 |

FOREIGN PATENT DOCUMENTS

| | | | |
|---|---|---|---|
| 8808730 | 11/1988 | WIPO | 482/908 |

*Primary Examiner*—Stephen R. Crow

[57] ABSTRACT

A hand grip assembly for a cross-country ski exerciser or similarly-gripped exercise equipment that incorporates multiple anchor points by which the hand grip assembly is secured to said exercise equipment. By changing the anchor point on the hand grip during a workout, an individual may engage in a more diverse use of the exercise equipment to which the present invention is attached, thereby effectively improving the overall functionality of said exercise equipment.

1 Claim, 2 Drawing Sheets

ALTERNATE EMBODIMENT

HAND GRIP ASSEMBLY FOR CROSS-COUNTRY EXERCISER OR SIMILARLY-GRIPPED EXERCISE EQUIPMENT

BACKGROUND OF THE INVENTION

The present invention relates generally to an improved hand grip assembly for a cross-country ski exerciser or similarly-gripped exercise equipment. The improved hand grip assembly includes multiple anchor points to which a tension-generating device or weights may be secured. The hand grip assembly may be quickly an easily switched between anchor points without unfastening the rope or cable by which the hand grip assembly is secured to an exercise machine. The hand grip assembly improvements increase the functionality of the exercise equipment to which the present invention is attached by providing for a more diverse use of said exercise equipment.

Standard hand grips for exercise equipment are designed for a particular, single purpose. For example, a hand grip for a cross-country ski device allows for exercising portions of the upper body and arms by holding onto the grips while simulating a skiing motion. Another example is a hand grip attached to weights via a cord or cable that allows for pulling or lifting.

Typically, a hand grip has a single anchor point by which it is attached to an exercise machine. When attached to weights or various other tension-generating devices, this kind of grip limits the direction of force applied when engaging in a pulling motion. Consequently, the workout resulting from such activity is limited by the design of the grip and its intended use with the exercise equipment.

SUMMARY OF THE INVENTION

Accordingly, it is the primary object of the present invention to incorporate multiple anchor points on a hand grip assembly for a cross-country ski exerciser or similarly-gripped exercise equipment to overcome the limitations of the prior art with respect to the inclusion of only a single anchor point. Specifically, the present invention contains multiple anchor points that allows for switching anchor points by which the hand grip assembly is secured to an exercise machine.

It is another object of the present invention to provide for a more diverse workout by allowing an individual to exercise different muscle groups. By switching anchor points, a broader range of motion is possible which may subsequently result in a better exercise regiment. Use of the present invention improves the overall effectiveness of the exercise equipment.

It is another object of the present invention to allow for quickly switching the anchor point of the hand grip assembly without interrupting the flow of the exercise. Means are provided to change from one anchor point to another within a few seconds without unfastening the rope or cable by which the hand grip assembly is attached to said exercise equipment.

BRIEF DESCRIPTION OF THE DRAWINGS

The accompanying drawings incorporated in and forming a part of the specification illustrate several aspects of the present invention and combined with the description explain the principles thereof.

DETAILED DESCRIPTION OF THE INVENTION

Figure 1:
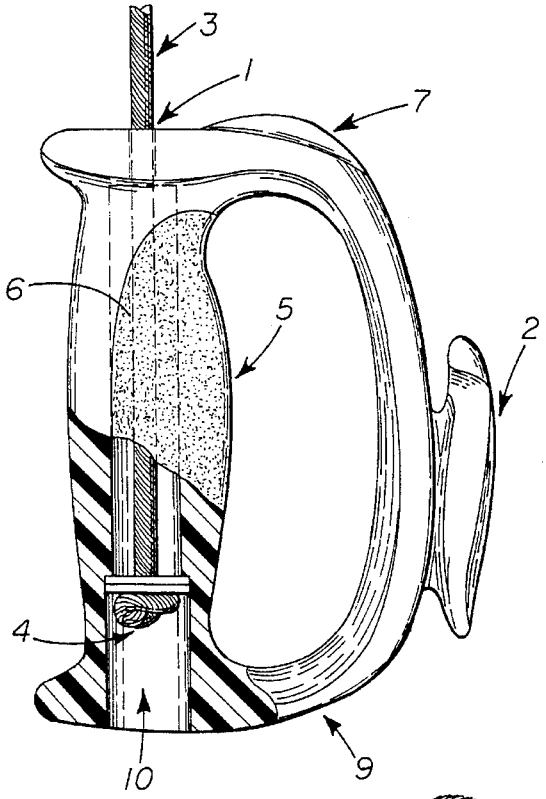
FIG. 1. is a partial exploded perspective view that illustrates the design of the present invention and how a rope or cable may be secured to the top anchor point.

FIG. 1o shows a hand grip assembly 9. The rope 3 is secured at the top anchor point 1 in any appropriate manner. One option is to insert a rope 3 through a hole at the top anchor point 1 so that the rope extends through the hollow core 6 out the bottom of the grip 10 where the rope 3 may be knotted 4 and pulled in to position within the hollow core 6 of the hand grip assembly 9. FIG. 1 also illustrates a protuberance 7 near the top of the hand grip assembly 9 that serves to guide the rope or cable 3 on to the front anchor point 2. The curvature 5 of the hand grip assembly is preferably designed to accommodate an individual's hand in a comfortable manner.

Figure 2:
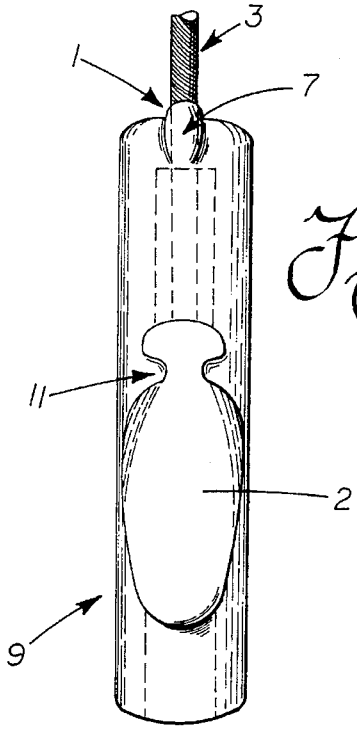
FIG. 2. is another perspective view that illustrates several structural elements of the present invention.

FIG. 2 shows a preferred embodiment of the front anchor point 2 with a notch 11 designed to secure a rope 3 in place when wrapped around the front anchor point 2 on the hand grip assembly 9.

Figure 3:
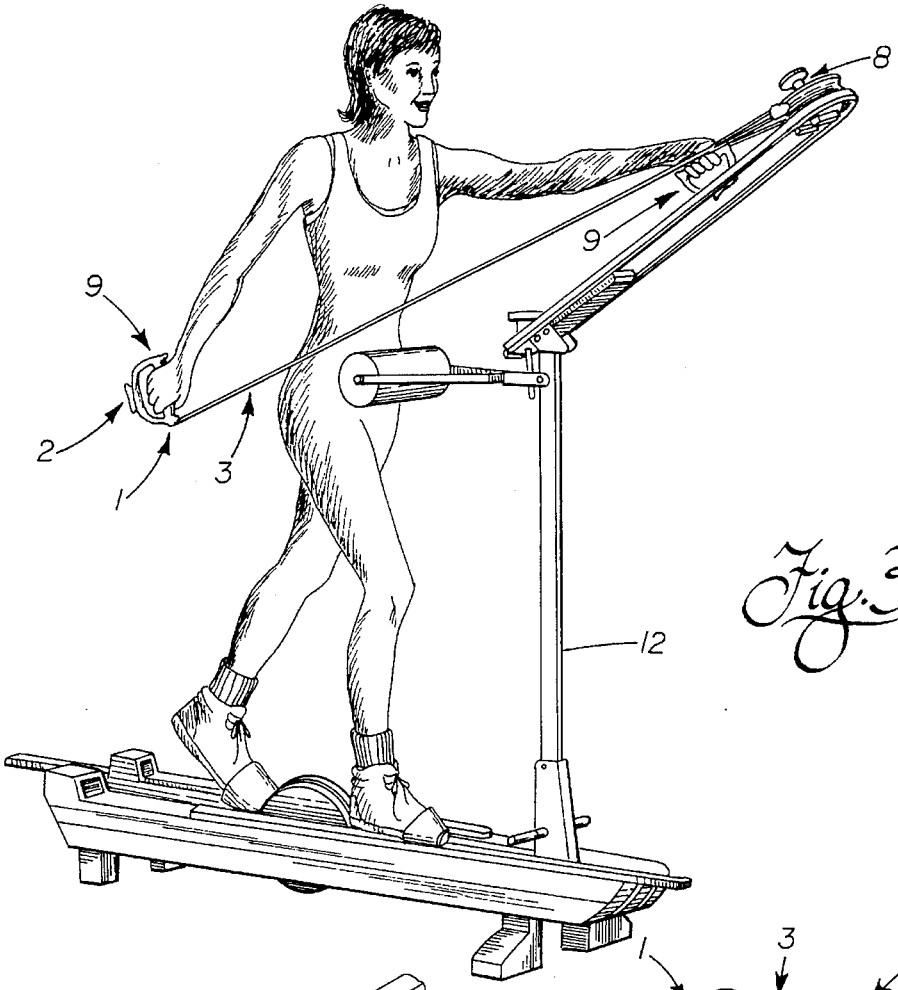
FIG. 3. illustrates one potential use of the present invention where the hand grip assembly is attached at the top anchor point by a rope to a cross-country ski exerciser being used to simulate a skiing motion.

FIG. 3. illustrates the use of a cross-country ski exerciser 12 equipped with the hand grip assembly 9 that is secured at the top anchor point 1 so as to allow an individual to engage in a normal skiing motion. The front anchor point 2 in no way hinders the use of the exercise equipment 12. The force exerted on either the top anchor point 1 or front anchor point 2 may be adjusted by using the tension-generating device 8.

Figure 4:
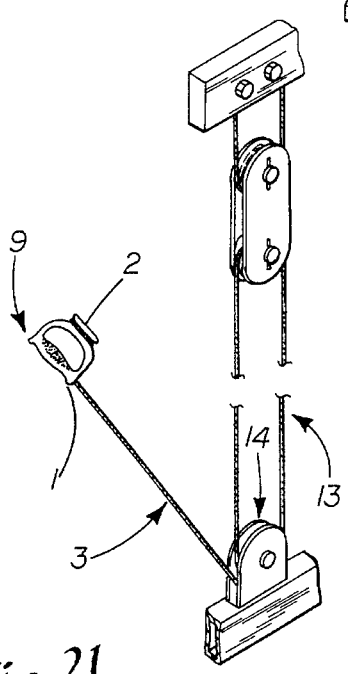
FIG. 4. depicts the present invention attached to another type of exercise equipment.

FIG. 4 demonstrates that the hand grip assembly 9 may be attached to other exercise equipment 13 by a cable or rope 3. The exercise equipment 13 may use a pulley 14, weights, or another tension-generating device.

Figure 5:
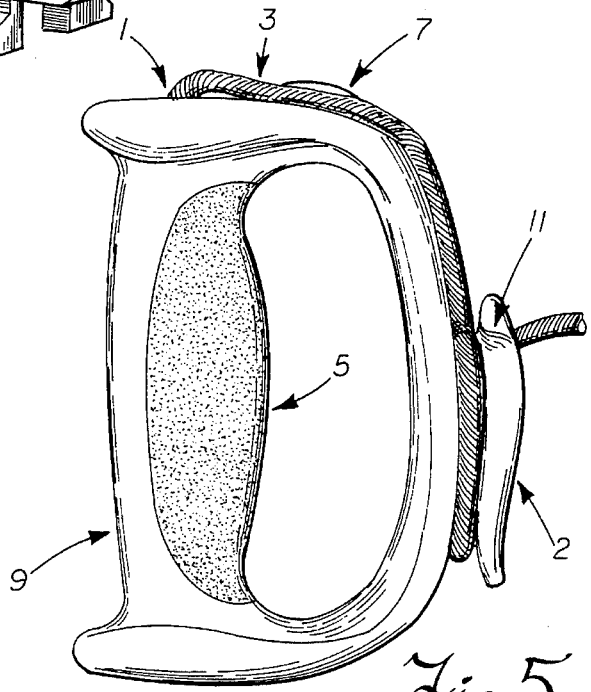
FIG. 5. illustrates how a rope or cable may be secured to the front anchor point of the present invention.

FIG. 5. illustrates how a rope 3 (cord or cable) is secured to the front anchor point 2 of the hand grip assembly 9. The rope 3 may be wrapped one or more times around the front anchor point 2 to adjust the length of the rope 3 and held in place by the notch 11 on the front anchor point 2. The protuberance 7 near the top of the hand grip assembly 9 guides the rope 3 to facilitate the process of securing it to the front anchor point 2. The front anchor point 2 is positioned on the hand grip assembly 9 to direct the force to the center of the hand grip 9. When the hand grip assembly 9 is secured to an exercise machine by the front anchor point 2 as illustrated in FIG. 5, the direction of force is altered such that force is placed against the fingers.

Figure 6:
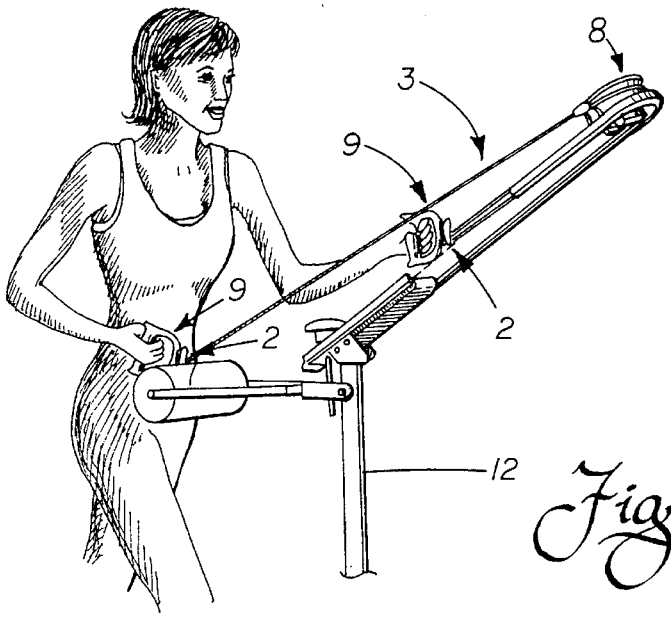
FIG. 6. demonstrates the use of the present invention on a cross-country ski exerciser or similar exercise equipment when a rope is secured to the front anchor point.

FIG. 6 illustrates how the hand grip assembly 9 may be used with a cross-country ski exerciser 12 when secured to said exercise equipment by the front anchor point 2. Switching anchor points allows for a broader range of motion. The force exerted on the hand grip assembly 9 may be controlled by adjusting a tension-generating device 8 or by other means. Use of the hand grip assembly 9 as demonstrated in FIG. 6 does not hinder the lower body skiing motion.

While the present invention described herein is the preferred embodiment, other embodiments will be obvious to those skilled in the art such that the scope of the present invention be limited only by the claims appended hereto.

Having described my invention, I claim:

1. An improved handgrip assembly for an exercise machine having a cord tension means, said handgrip assembly comprising: a generally D-shaped handle having a gripping portion and a curved non-gripping portion, said gripping portion having an axial bore for the reception of said cord means; means within said bore for anchoring an end of said cord means; and anchor means located on the curved portion which engages a length of said cord means to effectively change the length of said cord means.

* * * * *